United States Patent [19]

Anikanov et al.

[11] 3,986,711

[45] Oct. 19, 1976

[54] TUCKER FOLDER FOR NEWSPAPER ROTARY PRINTING PRESSES

[76] Inventors: Nikolai Ivanovich Anikanov, ulitsa Bolshaya Bronnaya, 2/6, kv. 6; Leonid Pavlovich Grachev, ulitsa Lva Tolstogo, 7, kv. 32, both of Moscow; Grigory Iosifovich Zax, ulitsa Mechnikova, 14a, kv. 24, Kiev; Grigory Avramovich Radutsky, 16 Parkovaya ulitsa, 49, korpus 2, kv. 68, Moscow; Rafail Efimovich Kheifets, Brest-Litovsky prospekt, 162, kv. 30, Kiev, all of U.S.S.R.

[22] Filed: Dec. 2, 1974

[21] Appl. No.: 528,988

Related U.S. Application Data

[63] Continuation of Ser. No. 422,148, Dec. 6, 1973, abandoned.

[30] Foreign Application Priority Data

July 12, 1973 U.S.S.R. ..... 1933451

[52] U.S. Cl. ..... 270/77

[51] Int. Cl.[2] ..... B65H 45/16

[58] Field of Search ..... 270/76–77, 270/42, 49, 50, 20, 8; 214/6 M, 6 N, 6.5

[56] References Cited

UNITED STATES PATENTS

| | | | |
|---|---|---|---|
| 215,844 | 5/1879 | Tucker | 270/77 |
| 556,409 | 3/1896 | Firm | 270/8 |
| 573,348 | 12/1896 | North | 270/76 |
| 658,209 | 9/1900 | Firm | 270/8 |
| 3,517,920 | 6/1970 | Snyder | 270/77 |

FOREIGN PATENTS OR APPLICATIONS

| | | | |
|---|---|---|---|
| 275,366 | 8/1927 | United Kingdom | 270/77 |
| 29,568 | 10/1914 | United Kingdom | 270/77 |

*Primary Examiner*—Edgar S. Burr
*Assistant Examiner*—A. Heinz
*Attorney, Agent, or Firm*—Holman & Stern

[57] ABSTRACT

A tucker folder having a pair of rotating folding rollers adjacent to which at least one other pair of similar folding rollers is located. The rotational centers of the rollers in these other pair of rollers has an arc of the same radius as that of the first pair. The folder of the tucker folder is equipped with means for alternating interaction between the tucker blades and the two pairs of the folding rollers to divide the newspapers emerging from the folder into separate streams. A cam controlling the operation of picking pins is capable of being shifted with respect to the spaces defined between the folding rollers, depending on the interaction between the tucker blades and the respective pair of the folding rollers, to form a transverse fold in the middle of the paper sheet, irrespective of the stream taking this sheet.

2 Claims, 2 Drawing Figures

TUCKER FOLDER FOR NEWSPAPER ROTARY PRINTING PRESSES

This is a continuation of application Ser. No. 422,148 filed Dec. 6, 1973, now abandoned.

BACKGROUND OF THE INVENTION

This invention relates to tucker folders used in newspaper rotary printing presses.

Tucker folders are known in the art which are provided with picking pins (i.e. needles arranged in line on a base) carried by a folder drum and controlled by a cam. These pins are adapted to hold a printed web on the surface of the folding drum during rotation thereof. The tucker folders are also provided with shafts which are also carried by the folding drum and have tucker blades adapted to initiate a transverse fold on a paper sheet. A pair of folding rollers rotating in opposition is arranged below the folding drum. A space is formed between the folding rollers, the space receiving a folded sheet fed thereinto by the tucker blade, the folded sheet being then delivered from the folder.

To stack the sheets delivered from the folder into piles of newspapers, it is necessary to separate them into separate streams, the newspapers then being subsequently placed into bins by fly-type delivery wheels. The separation of newspapers into streams as described above may be performed with the use of a deflector either mechanically or electrically connected to the folder drum drive.

Though the devices of the kind referred to are reliable in separating the folded newspapers into streams, the deflector is to be switched within a time interval between two successive newspapers, this interval depending on the printing speed. Thus, if the rotational speed of the impression cylinders is about 40,000 rpm, the duration of the above-mentioned interval would be only 0.0225 s.

In view of the present trend in the field of newspaper production to increase the speed of printing, the time interval between successive newspapers is liable to be decreased. This fact may complicate switching of the deflector within such a short interval. This may lead to inadequate utilisation of the printing press capacity.

SUMMARY OF THE INVENTION

It is an object of the present invention to provide a tucker folder for use in newspaper rotary printing presses which, without the use of any additional means, creates directly at the delivery end of the folder a required number of newspaper streams fed each into a bin for stacking and which also ensures reliable distribution of the newspapers between the streams at extremely high printing speeds.

The above and other objects are achieved in a tucker folder for newspaper rotary printing presses according to the invention, comprising a folder drum provided with picking pins controlled by a cam and adapted to hold a paper web on the fold drum during rotation thereof, and having shafts carrying tucker blades serving to form a transverse fold on a paper sheet, and a pair of spaced folding rollers arranged under the folder drum and rotating in opposition, a folded paper sheet being fed into the space between the rollers by the tucker blade, according to the invention, at least one other pair of similar folding rollers is positioned in proximity to the first pair of rotating folding rollers, the rotational centers of the rollers of the other pair being arranged along the arc of the same radius as that of the first pair of the folding rollers, the folder drum being provided with means for effecting alternating interaction between the tucker blade and the two pairs of folding rollers to separate the newspapers emerging from the folder into separate streams, and in that the cam controlling the picking pins is capable of being shifted with respect to the spaces between the folding rollers depending on the interaction between the tucker blades and the respective pair of folding rollers to make a transverse fold in the middle of the paper sheet irrespective of the stream into which this sheet is directed.

It is expedient to provide the means for alternating interaction between the tucker blades and the two pairs of the folding rollers with a sun gear connected to the shafts of the tucker blades through idler gears, which sun gear is adapted to be oscillated by means of a rack-and-pinion mechanism, the pinion of this mechanism being fixed on a common shaft with the sun gear and the rack being connected to the drive means.

To displace the cam controlling the operation of the picking pins relative to the space between the folding rollers, this cam may be mounted on the pinion of the rack-and-pinion mechanism.

The main principle of the invention resides in the following.

It has become possible, due to the availability of a set of pairs (at least two) of folding rollers and due to the fact that the folder drum is equipped with means for alternative interaction between the tucker blades and these two pairs of the folding rollers, to have directly at the outlet of the folder, distribution of folded newspapers into separate streams without incorporation of any conventional means generally used for this purpose (a deflector, etc.).

Furthermore, it has become practically possible to double the time interval necessary to "switch" the folded newspapers from one stream to the other, since in this case the resetting of the tucker blade for interaction with the other pair of the folding rollers may be carried out in the time interval between folding of two successive newspapers (i.e. during 0.045 s.), while in conventional folders using a deflector for distribution of newspapers into streams the switching of this deflector has to be performed in one half of this time interval, i.e. in 0.0225 s., this time interval being determined by the spacing between two successive folded newspapers.

This two fold increase in the time required for switching the folded newspapers from one stream to the other makes it possible to handle the printed newspapers (i.e. assembling of piles and batches) at very high printing speeds which is particularly important for efficient utilization of present-day high-speed printing presses.

BRIEF DESCRIPTION OF THE DRAWINGS

The invention will now be explained in greater detail with reference to a specific embodiment thereof which is represented in the accompanying drawing, wherein.

DETAILED DESCRIPTION OF PREFERRED EMBODIMENTS

Figure 1:
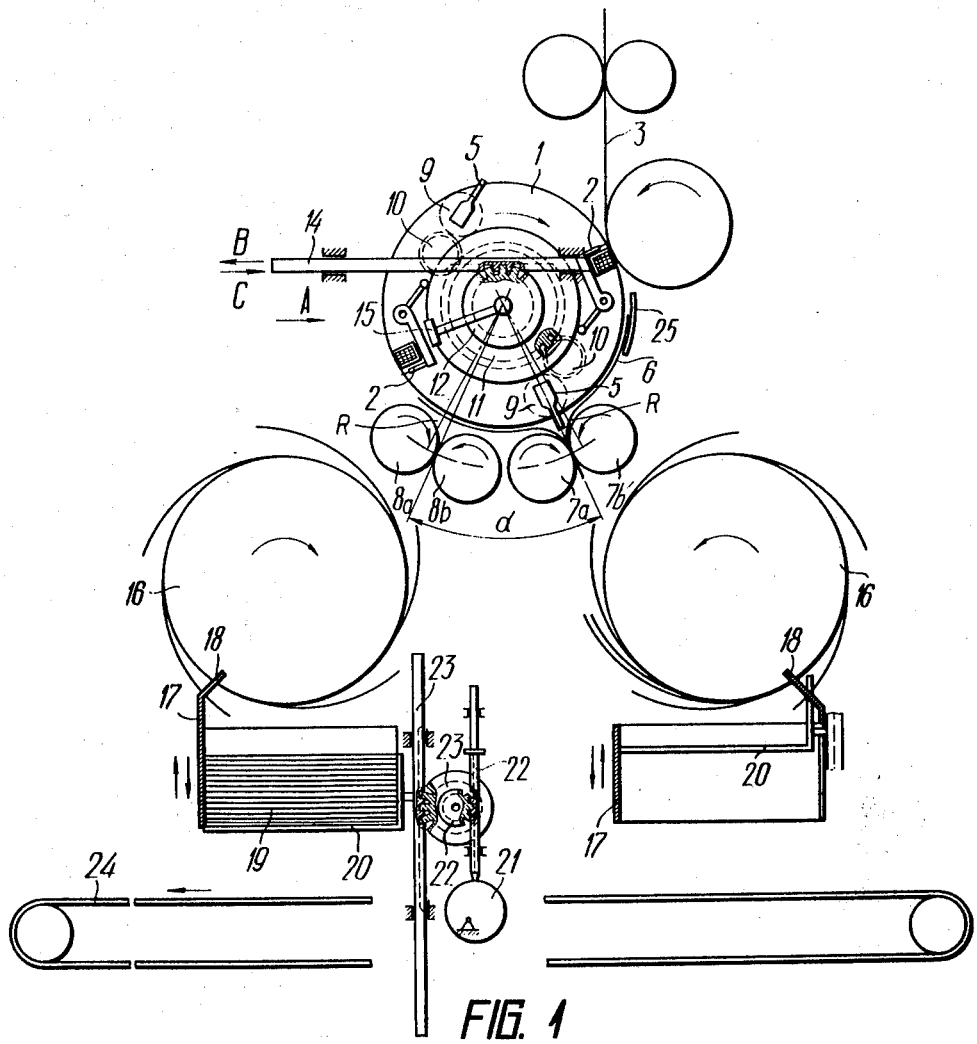
FIG. 1 is a side elevation of a folder according to the invention, provided with means for delivering the newspapers coming therefrom.

Referring to the drawings, a tucker folder is shown comprising a folder drum 1 (FIG. 1) provided with picking pins 2 adapted to hold a paper web 3 on the surface of the folder drum during rotation thereof and also provided with shafts 4 carrying tucker blades 5 rigidly fixed to the shafts, the blades serving to form a transverse fold on a newspaper sheet 6.

Two pairs of folding rollers 7*a* and 6*b* and 8*a* and 8*b* rotating in opposition are installed below the folder drum 1, the rollers in each pair being spaced sufficiently to form a nip to receive newspapers directed thereinto by the interaction of tucker blades 5 to form a transverse fold.

Both pairs of the folding rollers 7*a* and 7*b* and 8*a* and 8*b* are arranged so that the rotational centers thereof are at the same radial distance R from the axis of the folder drum and are offset with respect to each other in such a way that angle "$\alpha$" is defined between the symmetry axes thereof. The symmetry axis is defined as a line normal to the straight line connecting the centers of rotation of one pair of the folding rollers and passing through the middle thereof. The value of angle "$\alpha$" is selected as a structural parameter ensuring optimal location of the means for stacking the folded newspapers delivered in separate streams after having passed through the tucker folder.

Figure 2:
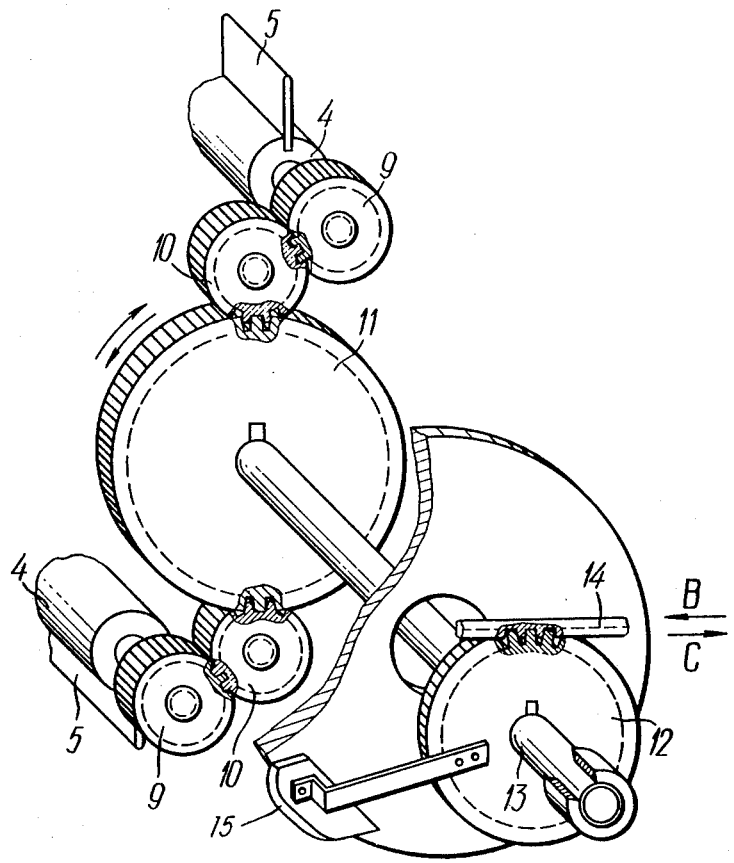
FIG. 2 is an enlarged view along arrow A in FIG. 1, illustrating a device for alternating interaction of the tucker blades with the two pairs of folding rollers.

Planetary gears 9 (FIG. 2) are mounted on each of the shafts 4, the planetary gears 9 being connected to a sun gear 11 through idler gears 10. Being mounted to execute oscillation, the sun gear 11 functions as means ensuring alternating interaction between the tucker folders 5 and the two pairs of the folding rollers 7*a* and 7*b* and 8*a* and 8*b*.

Oscillation of the sun gear 11 is effected by means of a rack-and-pinion mechanism comprising a pinion 12 fixed on a common shaft 13 with the sun gear 11 and a rack 14 connected to drive means (not shown in the drawings). The drive means may have any suitable structure. The choice of the structure of the drive means depends mostly on the manner of distribution of the newspapers into separate streams. To ensure division of the newspapers into streams containing the same number of the newspapers, it is expedient to provide mechanical drive means for the rack 14, e.g. a cam mechanism ensuring oscillation of the sun gear 11 through angle "$\alpha$" under a stringent program.

To divide the newspapers into streams with unequal number of newspapers in the streams, it is mostly advantageous to provide drive means controlled from a programming device comprising a counter to register the number of the newspapers fed to either of the streams.

A cam 15 is fixed to the gear 12, the cam controlling the operation of the picking pins 2 and being capable, due to the rigid connection to the gear 12, of being oscillated through angle "$\alpha$" along with the sun gear 11 and thus of being shifted with respect to the spaces between the folding rollers 7*a* and 7*b* and 8*a* and 8*b* depending on the interaction between the tucker blades 5 and a respective one of the pairs of folding rollers. This feature aids in forming the transverse fold in the middle of the newspaper irrespective of the stream taking this newspaper.

Delivery fly wheels 16 (FIG. 1) are arranged below each pair of the folding rollers 7*a* and 7*b* and 8*a* and 8*b* bins 17 with comblike stops 18 serving to collect piles 19 of newspapers being located under the fly wheels. Each bin 17 has a bottom 20 in the form a fork-like element adapted to be reciprocated in a vertical plane by means of a cam 21 through rack mechanisms 22 and 23. The bottom 20 is fixed to the rack of the mechanism 23.

A conveyor 24 is provided to remove the collected piles 19.

The operation of the above-disclosed mechanisms will be described in connection with directing of newspapers by the tucker blade 5 into the nip of the folding rollers 7*a* and 7*b* (FIG. 1).

In order to make a fold in the newspapers during the pushing thereof by means of the tucker blades 5 into the space between the folding rollers 7*a* and 7*b*, it is necessary to shift the rack 14 (FIG. 2) in the direction of arrow "B".

In this way the gears 11 and 12 are rotated in a counter-clockwise direction and the cam 15 is positioned at such a distance from the space between the folding rollers that, when the tucker blades enter this space, the picking pins will have pulled one half of the length of a newspaper with respect to the space. When the tucker blade 5 strikes the web, the leading end of the web is released by the picking pins, as they come into engagement with the cam 15, and at the same time after severence from the web the newspaper is separated from the latter and is fed in the folded form to the delivery fly wheel 16.

After a required number of newspapers has been passed through the space between the folding rollers 7*a* and 7*b*, the stream of newspapers is switched to the space between the other pair of folding rollers 8*a* and 8*b*.

To this end, the rack 14 is shifted in the opposite direction (along arrow "C") with the result that the gears 11 and 12 are rotated in a clockwise direction through angle "$\alpha$", while the tucker blades 5 enter the space between the folding rollers 8 only when the idler gears 10 have passed an additional distance equal to that extent of the pitch circle of the sun gear 11 which is defined by angle "$\alpha$".

Due to the rotation of the gear 12, the cam 15 will be set in such a position with respect to the space between the folding rollers 8 which it is similar to the one it had occupied with respect to that between the folding rollers 7*a* and 7*b* in the moment of pushing the newspapers into last-mentioned space. In this case the severed end of the newspaper is held by a plate 25 until it is struck by the tucker blade 5.

The time interval between folding of two successive newspapers at 40,000 revolutions of the folder drum per hour is equal to 0.045 s. This time interval is quite sufficient to rotate the gears 11 and 12 through angle "$\alpha$", i.e. to switch the newspaper stream to either pair of the folding rollers.

After having been folded, the newspapers are placed by means of the delivery fly wheel 16 onto the bottoms 20 of the bins 17, the bottoms being movable in a vertical plane. As a pile of newspapers in the bin is built up, the bottom of the bin is lowered, and a collected pile 19 is transferred to a delivery conveyor 24.

What is claimed is:

1. A tucker folder for newspaper rotary printing presses, comprising: a folder drum having a rotation axis; a plurality of shafts mounted on said folder drum, each shaft carrying a tucker blade serving to form a transverse fold on a paper sheet; at least two pairs of folding rollers, each arranged on a respective rotation axis, each pair of said rollers rotating in opposite directions, and the rotation axes of the said rollers being arranged at an equal radial distance from said rotation axis of said folder drum, said rollers being disposed relative to the folder drum so as to interact with the tucker blades mounted on said folder drum to feed each pair of rollers a folded newspaper sheet into a gap between said rollers; a means for effecting alternating interaction between the tucker blades and one of the two pairs of folding rollers to divide the sheets coming from said folder drum into separate streams, said means for effecting the alternating interaction being actuated during the rotation of the folder drum at a working speed and comprising a sun gear interacting with the shafts of the tucker blades through idler gears, said sun gear being secured on a rotary shaft capable of rotating the sun gear from one position to another, when the blades interact with one pair of the folding rollers the sun gear is in one position, while in the other position the same blades interact with the other pair of rollers with the result that the newspaper sheets are directed from one stream to another during the process of the press operation; means for turning said rotary shaft into said two positions; picking pins mounted on said drum for holding a newspaper sheet on the surface of the folder drum during the rotation thereof; a cam means for controlling said picking pins, said cam means being capable of moving during the rotation of the folder drum at a working speed in two positions relative to each pair of the folding rollers so as to effect the interaction with the picking pins in conjunction with the pair of the folding rollers which the blades feed the newspaper sheets into; wherein the means for turning said rotary shaft of the sun gear is a rack and pinion mechanism, the gear of said mechanism being rigidly secured on said rotary shaft common with said sun gear, while the rack of said mechanism is connected with a drive for movement thereof in a predetermined direction.

2. The tucker folder according to claim 1, wherein the cam means is rigidly secured on the gear of the rack and pinion mechanism so that while rotating together with said gear said cam means will interact with said picking pins at the pair of said folding rollers that the tucker blades feed newspaper sheets into.

* * * * *